United States Patent [19]

Giessner

[11] Patent Number: 4,518,943

[45] Date of Patent: May 21, 1985

[54] BIMETALLIC CIRCUIT BREAKER WITH AN AUXILIARY SWITCH

[75] Inventor: George J. Giessner, Cherry Hill, N.J.

[73] Assignee: Heinemann Electric Company, Lawrenceville, N.J.

[21] Appl. No.: 607,428

[22] Filed: May 7, 1984

Related U.S. Application Data

[63] Continuation of Ser. No. 426,237, Sep. 28, 1982, abandoned.

[51] Int. Cl.[3] ..... H01H 71/16

[52] U.S. Cl. ..... 337/68; 200/153 M

[58] Field of Search ..... 337/68, 91; 200/151, 200/153 M, 68.2

[56] References Cited

U.S. PATENT DOCUMENTS 3,361,888 1/1968 Brackett ..... 200/153

3,772,484 11/1973 Roeser ..... 200/68.2

*Primary Examiner*—Harold Broome

*Attorney, Agent, or Firm*—John C. Dorfman

[57] ABSTRACT

A bimetallic circuit breaker with a first or main set of movable and stationary contacts. The circuit breaker includes an electrical insulating slide restrained in one position by the movable contact and interposed between the contacts when these contacts are in the open position. The slide is carried by an insulator frame received within a housing of electrical insulating material. The frame is provided with a second or auxiliary set of movable and stationary contacts. The slide is positioned relative to the auxiliary contacts so that it keeps the auxiliary movable contact separated from the corresponding stationary auxiliary contact. When the bimetal flexes sufficiently, the slide is released and the main contacts open, and at such times the slide moves away from the auxiliary movable contact, permitting the auxiliary contacts to close for signalling, at a remote location, the opening of the main contacts. The circuit breaker includes a case having an end wall. The main set of contacts are carried by a pair of main terminals which extend through the end wall. The main terminals are disposed parallel to each other. The auxiliary movable contact is carried by an auxiliary terminal which is disposed at right angles to the main terminals and intermediate the main terminals.

4 Claims, 6 Drawing Figures

FIG. 1
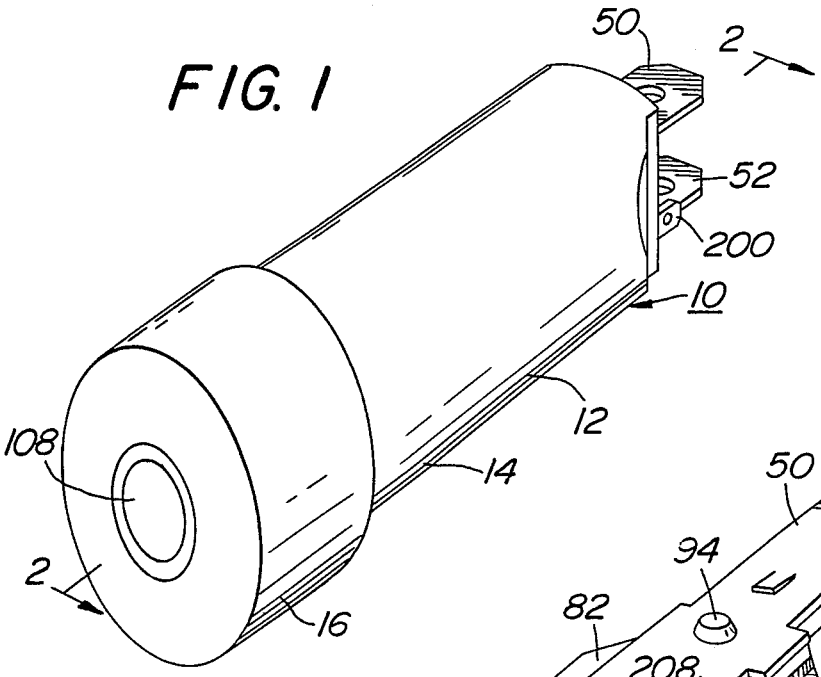
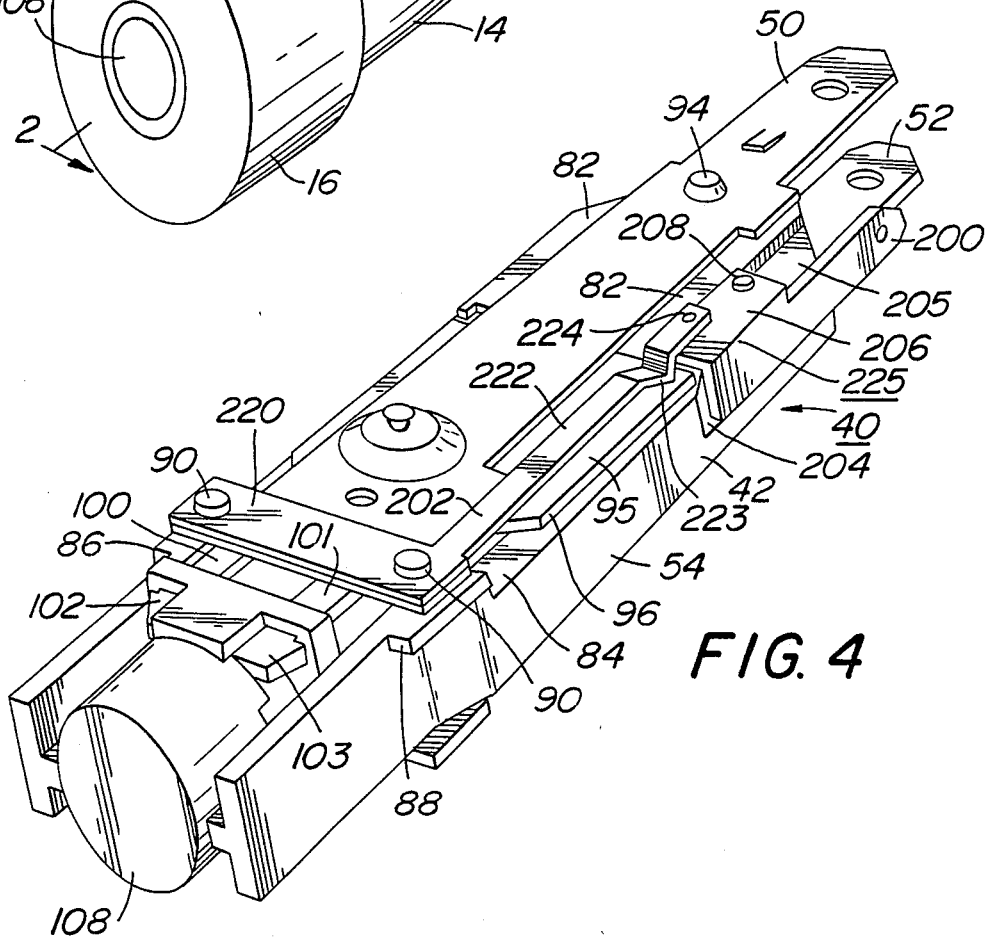
FIG. 4

FIG. 2
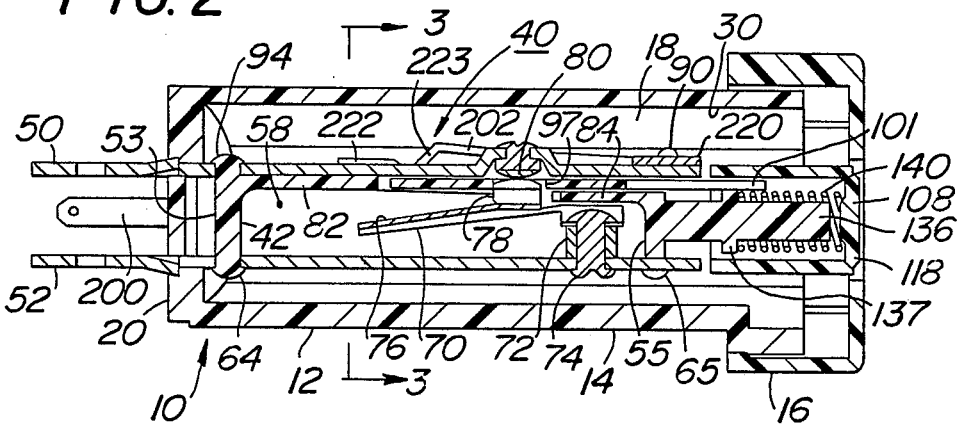
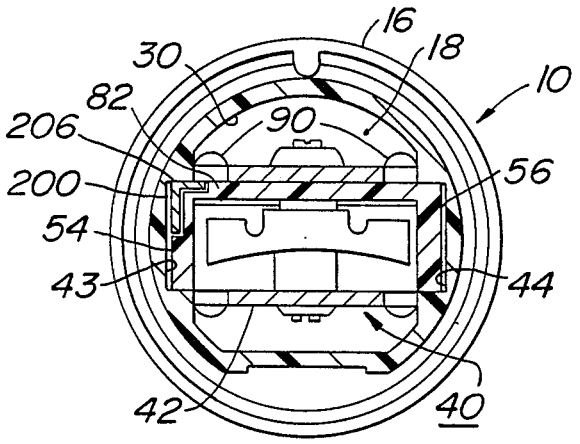
FIG. 3
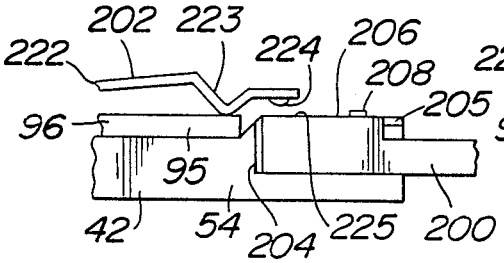
FIG. 5
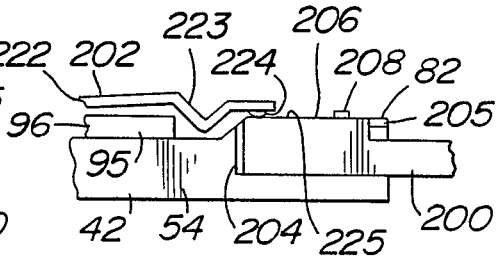
FIG. 6

BIMETALLIC CIRCUIT BREAKER WITH AN AUXILIARY SWITCH

RELATED PATENT APPLICATION

This application is a continuation of U.S. patent application Ser. No. 426,237, filed Sept. 28, 1982, and now abandoned, by George J. Giessner.

RELATED PATENTS

This application relates to bimetallic circuit breakers as shown in U.S. Pat. Nos. 4,068,203 and 4,123,737 both of which are assigned to the same assignee as the assignee of the present invention.

BACKGROUND OF THE INVENTION

This invention relates to auxiliary switches for circuit breakers of the bimetallic type.

In circuit breakers there is frequently a need to provide a signal at a location remote of the circuit breaker indicating whether the contacts of the circuit breaker are closed or opened. Auxiliary switches which are mechanically responsive to the position of the circuit breaker contacts are frequently provided for this purpose, the auxiliary switches being electrically connected to suitable lamps, for example, to indicate the status of the circuit breaker contacts.

BRIEF SUMMARY OF THE INVENTION

Thus, it is an object of this invention to provide an auxiliary switch for a known bimetallic circuit breaker, the circuit breaker shown in U.S. Pat. No. 4,068,203, which can be economically added during the manufacture of such circuit breakers without requiring substantial changes to the circuit breaker.

This invention provides an auxiliary switch comprising a stationary auxiliary contact forming part of a stationary auxiliary terminal secured to the frame forming part of a sub-assembly received within the circuit breaker housing. Secured to the frame is also a movable auxiliary blade carrying an auxiliary movable contact. The auxiliary blade is also carried by the frame in contact with one of the main terminals of the circuit breaker (the line terminal) so that when the auxiliary switch contacts are closed an auxiliary electrical circuit is completed through the line terminal, the auxiliary switch blade and the auxiliary switch stationary terminal to the lamp or similar indicating device. The frame carries a slide which is positioned, when the circuit breaker main contacts are closed, intermediate the auxiliary switch blade and the auxiliary switch stationary contact so as to keep the auxiliary switch contacts separated at such time. When the bimetallic blade of the circuit breaker overheats sufficiently to release the slide, the slide moves relative to the auxiliary switch blade so as to release the latter and permit it to engage the auxiliary switch stationary contact, thereby closing the electrical circuit to the lamp to signal the open condition of the circuit breaker contacts.

The foregoing and other objects of this invention, the principles of this invention, and the best mode in which I have contemplated applying such principles will more fully appear from the following description and accompanying drawings in illustration thereof.

BRIEF DESCRIPTION OF THE VIEWS

In the drawings,

FIG. 1 is a front and top perspective view of a bimetallic circuit breaker incorporating this invention;

FIG. 2 is a longitudinal, sectional view taken along the line 2—2 in FIG. 1 but at a larger scale than FIG. 1 showing the contacts closed position of the circuit breaker;

FIG. 3 is a cross-sectional view taken along the line 3—3 in FIG. 2;

FIG. 4 is a front and top perspective view of the sub-assembly for the circuit breaker shown in FIGS. 1, 2 and 3 incorporating this invention;

FIG. 5 is a partial side elevation showing the auxiliary terminals with the auxiliary contacts in the open position as in FIG. 4 and the slide keeping the auxiliary movable contact raised away from the stationary contact; and FIG. 6 is a partial side elevation showing the slide not supporting the auxiliary switch blade and the auxiliary contacts in the closed position.

DESCRIPTION OF THE PREFERRED EMBODIMENTS

Referring to the drawings, the circuit breaker 10 comprises an insulator housing 12, preferably molded from an electrically insulating plastic material, consisting of a tubular case 14 and a cover 16 therefor. The case 14 defines an elongated cavity 18, FIGS. 2 and 3, open at the right hand end but substantially closed at its left hand end by an end wall 20.

The interior wall 30 of the case 14 defining the elongated cavity 18 is generally circular in cross-section, as shown in FIG. 3, and receives a sub-assembly 40, illustrated in perspective in FIG. 4.

The sub-assembly 40 comprises a relatively long and narrow frame or block 42 of electrically insulating material, preferably molded from a suitable plastic. The frame 42 is generally rectangular in cross-section, as shown in FIG. 3, and has two opposite side walls 54 and 56 which are slidably received in two suitable channels 43 and 44 formed in the interior wall 30.

The frame 42 carries two elongated terminals 50 and 52 on its opposite sides, a slide 96 between the two terminals 50 and 52, a button 108 hinged to the slide 96 and a spring 140, FIG. 2, for biasing the slide 96 and the button 108 to the right, i.e., the contacts open position. The slide 96 and the button 108 are collectively referred to as an actuator 99.

The terminal 50 is the line terminal and the terminal 52 is the load terminal.

The frame 42 comprises the side walls 54 and 56 and end walls 53 and 55 together peripherally bounding a cavity 58 on four sides. The walls 53 and 55 define two lower surfaces at opposite ends of the frame 42 against which is placed the terminal 52. The walls 53 and 55 also include integral lugs 64 and 65 which extend through suitable holes in the terminal 52. The terminal 52 is secured to the frame 42 by ultrasonically deforming the ends of the lugs 64 and 65 which extend beyond the terminal so as to form bosses which are shown in FIG.2.

Prior to the assembly of the terminal 52 to the frame 42, however, a snap acting bimetallic blade 70 is secured to the terminal 52 on a post 72 by a rivet 74 which extends through the post 72 and suitable holes in the blade 70 and the terminal 52, the rivet 74 having its lower end peened over against the terminal 52, as shown in FIG. 2.

The blade 70 includes a tongue 76 which carries a movable contact 78 which in the contacts closed position of the circuit breaker abuts a stationary contact 80, as shown in FIG. 2. The stationary contact 80 is suitably secured to the line terminal 50, preferably by being riveted thereto, as shown.

The frame 42 includes a bridging wall 82, integral with the walls 53, 54 and 56, and another bridging wall 84 integral with the walls 54, 55 and 56. From the bridging wall 84 extend two platforms 86 and 88, FIG. 4, from which in turn, lugs 90 extend which extend through suitable holes in the terminal 50. Likewise, the bridging wall 82 has a lug 94 extending through a suitable hole in the terminal 50. The portions of the lugs 90 and 94 extending beyond the terminal 50 are ultrasonically heated to form bosses, as shown in FIGS. 2 and 4 to secure the terminal 50 against the bridging wall 82 and against the platforms 86 and 88

The side walls 54 and 56, the bridging wall 84, and the platforms 86 and 88 together with the terminal 50 define a recess which slidably receives the slide 96. The slide 96 includes a generally flat and wide body 95 having an opening 97. The movable contact 78 extends through the opening 97 into abuttment with the stationary contact 80 in which position movement of the slide 96-button 108 to the right under the bias of the spring 140 is restrained by engagement of the movable contact 78 with a part of the slide 96 defining the opening 97, as shown in FIG. 2.

The slide 96 also includes integral spaced legs 100 and 101, FIG. 4, with outwardly projecting feet 102 and 103, respectively. The slide 96 and the button 108 are made of suitable electrical insulating material.

From the peripheral wall 55 of the frame 42, a post 136 extends, FIG. 2, the post 136 including an annular boss 137 against which seats the spring 140. The spring 140 is carried around the post 136 and is in compression, the spring 140 being seated at its left against the boss 137 and at its right it bears against the inside vertical surface of the button head 118, so as to bias the actuator 99, i.e., the button 108-slide 96 sub-assembly, to the right both in the contacts closed and contacts open positions of the contacts 78 and 80.

With the slide 96-button 108 in the position shown in FIG. 2, the contact 78 is baised by the tongue 76 against the stationary contact 80, the movable contact 78 extending through the hole 97 in the slide 96, as shown. Upon sufficient heating of the blade 70, the tongue 76 snaps from the closed contacts position of FIG. 2 to the tripped open position (not shown) opening the contacts 78 and 80, and the slide 96-button 108 sub-assembly moves to the right under pressure of the spring 140, as viewed in FIG. 2.

Upon sufficient cooling of the blade 70, the tongue 76 snaps upwardly toward the position of FIG. 2, but is prevented from assuming the position of FIG. 2 by the slide 96, because the hole 97 in slide 96 has moved to the right and the contact 78 now engages the underside of the slide 96, preventing it from making contact with the stationary contact 80.

What has been described heretofore is essentially the circuit breaker shown and described in U.S. Pat. No. 4,068,203.

What has been done in this invention is to add an auxiliary stationary terminal 200 and an auxiliary movable blade 202 to the sub-assembly 40 and a suitable slot in the tubular case 14 through which the auxiliary stationary terminal 200 may extend, as shown in FIGS. 1 and 4.

As shown in FIG. 4, the wall 54 at the upper right hand portion of the frame 42 is formed with a recess 204 to receive the auxiliary stationary terminal 200, the depth of the recess 204 being slightly more than the thickness of the auxiliary stationary terminal 200 so that the sub-assembly 40 may still be inserted in the channels 43 and 44, as shown in FIG. 3. The bridging wall 82 is also recessed, as shown in FIG. 3 and 4, with a recess 205 adjacent the wall 54, to receive the top, flat horizontal part 206 of the auxiliary stationery terminal 200. A lug 208 extends from the bridging wall 82 through a suitable hole in the horizontal part 206 and the end of the lug 208 extending beyond the horizontal part 206 is ultrasonically heated to form a boss and thereby secure the auxiliary stationary terminal 200 to the frame 42.

Similarly, the auxiliary movable blade 202 is secured to the frame 42. The auxiliary movable blade 202 has a "L" shape and the base 220 (FIG. 4) of the "L" has two suitable holes through which the two lugs 90 extend. The auxiliary movable blade 202 is placed on top of the line terminal 50 and in contact therewith, as shown in FIG. 4, and thereafter the ends of the lugs extending through the auxiliary movable blade 202 are ultrasonically heated to form bosses for securing the line terminal 50 and the auxiliary movable blade 202 to the frame 42.

The vertical part 222 of the "L" of the auxiliary movable blade 202, extends along one side of the frame 42, as shown in FIG. 4. The right hand end portion of the part 222 of the auxiliary movable blade 202 is bent into a "V" shaped cam 223, as shown in FIGS. 4, 5 and 6 and the small portion to the right of the "V" is deformed into a dimple shape to form an auxiliary movable contact 224 integral with the blade 202 which overlies a portion of the auxiliary stationary terminal 200 forming an auxiliary stationary contact 225. The apex of the "V" shaped cam 223 rests upon the right hand portion of the slide 96, as shown in FIGS. 4 and 5, when the slide 96 is in the closed position of the circuit breaker contacts 78 and 80, the position of the contacts shown in FIG. 2, and when the cam 223 is in such position (upon the slide 96) its auxiliary movable contact 224 is spaced away from the auxiliary stationary contact 225, as shown in FIG. 5.

When the bimetallic blade 70 is sufficiently heated in overload, the tongue 76 snaps from the closed contacts position of FIG. 2 to the tripped open position (not shown) in which the movable contact 78 moves away from the stationary contact 80, thereby releasing the slide 96, whereupon the slide 96-button 108 sub-assembly moves to the right (as viewed in FIG. 2) under pressure of the spring 140.

Upon sufficient cooling of the blade 70 the tongue 76 snaps upwardly toward the position of FIG. 2, but is prevented from assuming the position of FIG. 2 by the slide 96, because the hole 97 in slide 96 has moved to the right and the contact 78 now engages the underside of the slide 96, preventing it from making contact with the stationary contact 80.

The circuit breaker 10 may be manually reset from the contacts open position to the contacts closed position of FIG. 2, as described, but will move from the contacts closed position of FIG. 2 to the contacts open position only on sufficient electrical overload, i.e., on flexing of the bimetal blade 70 sufficiently to move the contact 78 down out of restraining engagement with the slide 96. That is, the circuit breaker 10 may not be manually moved from the contacts closed to the contacts open position.

Referring to FIGS. 5 and 6, when the slide 96 moves to the left sufficiently, it permits the blade 202 to flex downwardly until the movable contact 224 engages the stationary contact 225, as shown in FIG. 6. It should be noted that there is enough space provided between the right hand edge of the slide 96 and the left hand edge of the auxiliary stationary terminal 200 for the "V" shaped cam 223 to freely enter without being obstructed by the adjacent wall of the frame 42. The auxiliary movable blade 202 is made of a sufficiently resilient material to permit it to flex into and out of contact with the auxiliary stationary terminal 200.

From the foregoing it is seen that the terminals 50 and 52 are disposed parallel to each other and are carried by opposite faces of the frame 42. The terminals 50 and 52 extend through the end wall 20, as shown in FIG. 2. The auxiliary terminal 200 is also carried by the frame 42 and extends primarily along the wall 54. The wall 54 is perpendicular to the faces of the frame 42 which carry the terminals 50 and 52. Thus, the auxiliary terminal 200 is disposed perpendicularly to the terminals 50 and 52. Further, the auxiliary terminal 200 is placed intermediate the two terminals 50 and 52. Since the case 20 is generally circular in shape it is seen that the parallel-perpendicular arrangement of these terminals occupies a minimum space within the circular bounds defined by the circular case 20.

When the circuit breaker 10 is in the open position of the contacts 78 and 80, not illustrated, and it is desired to reclose the contacts 78 and 80, the button 108 is manually depressed. The depression of the button 108 will cause the slide 96 to move from the position shown in FIG. 6 to the position shown in FIGS. 5 and 2. During such movement the forward portion of the slide 96 will engage the cam 223 and lift the auxiliary movable contact 224 away from the auxiliary stationary contact 225 causing them to open. Simultaneously, the circuit breaker movable contact 78 will enter into the opening 97 in the slide 96 and engage the stationary contact 80, as shown in FIG. 2.

It is seen from the foregoing that if a lamp (not shown) or other device is connected across the line terminal 50 and the auxiliary stationary terminal 200, the lamp will be energized when the circuit breaker contacts 78 and 80 are opened because at such time the auxiliary contacts 224 and 225 will be closed, thus providing a signal at a location remote of the circuit breaker indicating the open condition of the contacts 78 and 80.

In the appended claims, the phrase "main circuit breaker contacts" refers to the movable contact 78 and the stationary contact 80.

Having described the invention, I claim:

1. In a circuit breaker the combination of;

a case having an end wall, circuit breaker structure including circuit breaker contacts within said case, a pair of main terminals connected to each of said contacts extending through and out from said end wall, said main terminals being disposed parallel to each other, a frame within the case, an auxiliary terminal extending from a stationary auxiliary contact within the case on the frame through and out from said end wall, said auxiliary terminal being disposed at right angles to and intermediate said main terminals, an auxiliary movable blade including a movable contact arranged to make contact with the stationary auxiliary contact and electrically connected to one of said main terminals, an insulator slide within the case slidably mounted on the frame and movable from a first position assumed when the circuit breaker contacts are closed to a second position when the circuit breaker contacts are opened, said slide engaging said movable blade and keeping it separated from said stationary contact when said slide is in its first position and releasing said blade when said slide is in its second position to permit said movable contact of said blade to engage said stationary contact of the auxiliary stationary terminal.

2. The combination of claim 1 wherein the case provides channels to receive said frame and wherein the auxiliary stationary terminal is disposed between said frame and said housing in said channel and extends outwardly of said housing through an opening therein.

3. The combination of claim 2 wherein said frame includes a recess within which the auxiliary stationary contact is mounted.

4. The combination of claim 1, 2 or 3 wherein said auxiliary movable blade.includes a cam, said cam being supported upon said slide when said main circuit breaker contacts are closed to separate the auxiliary movable contact from the auxiliary stationary contact, and said slide being movable out of supporting relation with said cam when said main circuit breaker contacts open to permit said auxiliary movable contact to move into engagement with said auxiliary stationary contact.

* * * * *